US007625116B2

(12) United States Patent
Bron et al.

(10) Patent No.: US 7,625,116 B2
(45) Date of Patent: Dec. 1, 2009

(54) TIMEPIECE INCLUDING A MECHANISM FOR CORRECTING A DEVICE DISPLAYING A TIME RELATED QUANTITY

(75) Inventors: Alphonse Bron, Bassecourt (CH); Olivier Mahler, Boécourt (CH); Andrés Cabezas Jurin, Yverdon-les-Bains (CH)

(73) Assignee: Compagnie des Montres Longines, Francillon SA, St-Imier (CH)

( * ) Notice: Subject to any disclaimer, the term of this patent is extended or adjusted under 35 U.S.C. 154(b) by 104 days.

(21) Appl. No.: 11/935,880

(22) Filed: Nov. 6, 2007

(65) Prior Publication Data

US 2008/0106979 A1 May 8, 2008

(30) Foreign Application Priority Data

Nov. 6, 2006 (EP) ..... 06023029

(51) Int. Cl.
*G04F 7/00* (2006.01)

(52) U.S. Cl. ..... 368/101; 368/106

(58) Field of Classification Search ..... 368/89, 368/97–106, 112, 190–199
See application file for complete search history.

(56) References Cited

U.S. PATENT DOCUMENTS

| | | | | |
|---|---|---|---|---|
| 3,696,609 | A * | 10/1972 | Dubois | 368/220 |
| 3,775,966 | A * | 12/1973 | Matsuura | 368/32 |
| 3,797,226 | A * | 3/1974 | Inoki et al. | 368/197 |
| 3,820,318 | A * | 6/1974 | Fluck | 368/35 |
| 4,244,038 | A * | 1/1981 | Ganter et al. | 368/35 |
| 4,291,397 | A * | 9/1981 | Wuthrich et al. | 368/35 |
| 4,432,081 | A * | 2/1984 | Schwartz et al. | 368/35 |
| 5,043,955 | A * | 8/1991 | Dubois et al. | 368/228 |
| 5,392,260 | A * | 2/1995 | Kroener et al. | 368/36 |
| 6,327,226 | B1 * | 12/2001 | Russi | 368/228 |
| 7,029,169 | B2 * | 4/2006 | Takahashi et al. | 368/106 |
| 7,218,576 | B1 * | 5/2007 | Bron | 368/35 |
| 7,293,911 | B2 * | 11/2007 | Bonvin et al. | 368/97 |
| 7,331,706 | B2 * | 2/2008 | Gabathuler et al. | 368/106 |
| 2004/0095850 | A1 * | 5/2004 | Schmiedchen et al. | 368/190 |
| 2006/0126436 | A1 * | 6/2006 | Watanabe et al. | 368/28 |

FOREIGN PATENT DOCUMENTS

| | | | |
|---|---|---|---|
| CH | 660 440 | | 4/1987 |
| CH | 671 290 | A3 | 5/1990 |
| EP | 0 869 410 | A1 | 3/1998 |
| EP | 0 851 321 | A2 | 7/1998 |
| EP | 1 336 907 | A2 | 1/2003 |
| EP | 1 544 691 | A1 | 6/2005 |
| EP | 1 801 671 | A1 | 12/2005 |

OTHER PUBLICATIONS

European Search Report issued in corresponding application No. EP 06 02 3029, completed Jul. 13, 2007.

* cited by examiner

*Primary Examiner*—Vit W Miska
(74) *Attorney, Agent, or Firm*—Griffin & Szipl, P.C.

(57) ABSTRACT

Timepiece including a two-directional correction mechanism for a device displaying a time related quantity, the display device being actuated by a control lever (14) itself controlled by a cam (10), on which the control lever (14) abuts, the timepiece being characterized in that it includes a correction device (36) activated by a control stem (42) which, in the display device correction phase, via a return lever (24), moves the control lever (14) out of the path of the cam (10) on which said control lever (14) normally abuts in the normal operating phase of the timepiece (3).

19 Claims, 6 Drawing Sheets

TIMEPIECE INCLUDING A MECHANISM FOR CORRECTING A DEVICE DISPLAYING A TIME RELATED QUANTITY

This application claims priority from European Patent Application No. 06023029.9 filed Nov. 6, 2006, the entire disclosure of which is incorporated herein by reference.

The present invention concerns a timepiece including a mechanism for correcting a device displaying a time related quantity. More specifically, the present invention concerns a timepiece of this type including a two directional correction mechanism for a device displaying a time related quantity, such as a calendar mechanism.

Devices displaying a time related quantity such as calendar mechanisms are, largely, based on systems with a control arm that follow the profile of a cam and which, daily, actuate a date indicator member. Conventionally, at one point of its profile, the cam has a steep face or step which marks the passage from the last day of a given month to the first day of the following month. The presence of this steep face at one point on the cam profile causes a problem when one wishes to carry out a correction, for example of the date indication, in the anti-clockwise direction. Indeed, when one wishes to correct the date indication in the clockwise direction, in other words when one wishes to pass from a given date to a date that is one unit higher than the preceding date, there is no difficulty. The control arm follows the cam profile and moves the date indicator member forward step by step. When the control arm reaches the level of the steep face of the cam profile marking the passage from the last day of a given month to the first day of the following month, it falls, moving the date indicator member forward one step. The same is not true when one wishes to move the date indicator member backwards. Indeed, in this case, there will be a moment at which the control arm hits the steep face of the cam profile and is blocked. It then becomes impossible to correct the date indication.

Various solutions have been proposed to overcome this problem. By way of example, there is known from EP Patent Application No. 0 851 321 in the name of Seiko Instruments Inc, a multi-function timepiece including a lever for correcting the small hour hand which pushes a tail part of a hammer. The hammer is then pivoted anticlockwise and brought into a state in which it is no longer in contact with an actuating cam. The Seiko document does not disclose a two-directional corrector mechanism including a correction member in the form of an annular cam actuated by a control stem and able, via a return cam on which it acts, to move the arm away from a control lever of the cam on which said arm normally abuts.

There is also known from EP Patent No. 1 336 907, in the name of Richemont International S.A, an actuating mechanism for a timepiece time-setting device. More specifically, the actuating mechanism includes a control ring arranged concentrically relative to the centre of the watch. Depending upon the position of engagement of a crown, the control ring can occupy two radial positions via the effect of the action of a bent lever. The Richemont document omits to mention that the control ring has a cam profile on the inner periphery thereof.

There is also known from CH Patent No. 660 440 in the name of Dubois & Dépraz S. A., a perpetual calendar mechanism wherein the large lever is lifted by the lever of another lever mechanism. The Dubois & Dépraz document does not disclose a corrector mechanism wherein the arm of a control lever is moved away from the cam on which it normally abuts via a return lever which cooperates with the correction member, shaped like an annular cam.

Finally, from CH Patent No. 674 290 in the name of Roth, there is known a mechanism data display device and a timepiece fitted with the same. In one of the embodiments disclosed in this document, it can be seen that when a crown is manipulated using a push-button, a lever with two arms is moved, which causes the toothing of the rack thereof to drive a pinion. This document does disclose an actuating device in the form of an annular cam. However, it omits to disclose the actuation of a control cam via a return cam that cooperates with the cam profile provided on the inner periphery of the annular cam.

In light of the foregoing, it is an object of the present invention to provide a timepiece including a new type of correction mechanism for a device displaying for example the date, for correcting the latter both clockwise, in other words forwards, and anti-clockwise, in other words backwards.

The present invention therefore discloses a timepiece including a two-directional corrector mechanism for a device displaying a time related quantity, such as the date, the display device being actuated by a control lever carrying a rack and controlled by a cam on which the control lever abuts via an arm, the control lever being made to abut on the cam and said display device being moved backwards by a second lever called the return lever, which also carries a rack, a correction member actuated by a control stem for moving the control lever arm away from the cam on which it normally abuts, via the return lever.

Owing to these features, the present invention provides a timepiece including a correction mechanism which can correct, both forwards and backwards, a device displaying a time related quantity, such as a date display device, despite the fact that this display device is actuated by a lever that is itself controlled by a cam. This remarkable result is obtained owing to the fact that the corrector mechanism according to the invention includes a second lever controlled, via a control stem, by a disconnecting gear member and which moves the control lever momentarily out of the path of the cam on which said control lever normally abuts. The user can thus correct the display mechanism backwards since, although the cam is rotating, the control lever is not on its path and will not strike the latter.

According to a complementary feature of the invention, the correction mechanism is formed by an annular cam activated by the control stem and on the profile of which the return lever abuts via an arm.

There is thus a circular part, advantageously centred on the centre of the timepiece movement. Because of its geometrical shape and flatness, this part is relatively easy to manufacture and can also control several devices displaying a time related quantity provided at different locations on the perimeter thereof.

Other features and advantages of the present invention will appear more clearly from the following detailed description of an example embodiment of the correction mechanism according to the invention, this example being given purely by way of non-limiting illustration with reference to the annexed drawing, in which.

The present invention proceeds from the general inventive idea which consists in providing a timepiece including a correction mechanism for a device displaying a time related quantity such as a date device that can correct the device in both directions, in other words both forwards and backwards. In order to achieve this object, the present invention teaches that the control lever of the display device must be moved out of the path of the cam in the backwards correction phase. There is therefore provided a disconnecting or decoupling mechanism which, actuated by a control stem, moves the control lever arm away from the cam on which it normally abuts, via another lever called the return lever.

The present invention will be described in relation to a date display device. However, as will become clear from reading this description, the invention is not limited to a date display device and can equally apply to a day display device, a 24 hour display device and more generally to any type of device displaying a time related quantity.

Figure 1:
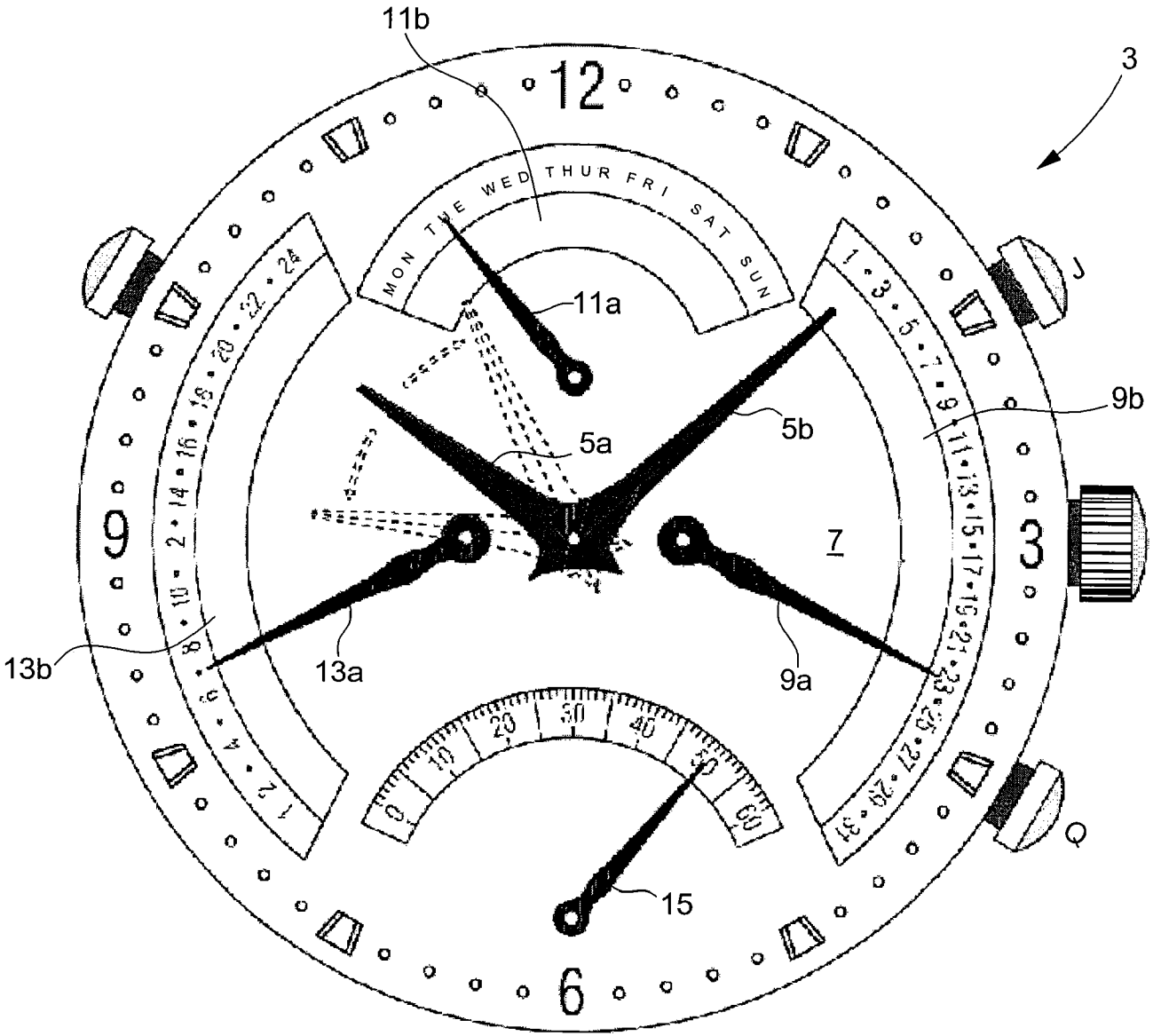
FIG. 1 is a plan view of the dial of the watch including the correction mechanism according to the invention.

An example embodiment of a timepiece including the correction mechanism according to the invention is shown in FIG. 1. Designated as a whole by the general reference numeral 3, this timepiece includes at the centre thereof a set of time-zone hands formed by an hour hand 5*a*, a minute hand 5*b* and a second hand 5*c*, which move above a circular dial 7. The time-zone mechanism has already been disclosed in EP Patent Application No. 1544691 in the name of the Applicant and will not therefore be described further here.

Watch 3 is completed by:

- a backward or retrograde date display formed by a hand 9*a* which moves in front of a scale 9*b* in the shape of an arc of a circle that extends between the "1" and the "31",
- a backward day of the week display formed by a hand 11*a* which moves along a scale 11*b* marked from "lundi" to "dimanche";
- a backward 24 hour display formed by a hand 13*a* that moves along a scale 13*b* in the shape of an arc of a circle that extends between "1" and "24".

The watch display is completed by a small second indication 15.

Figure 2:
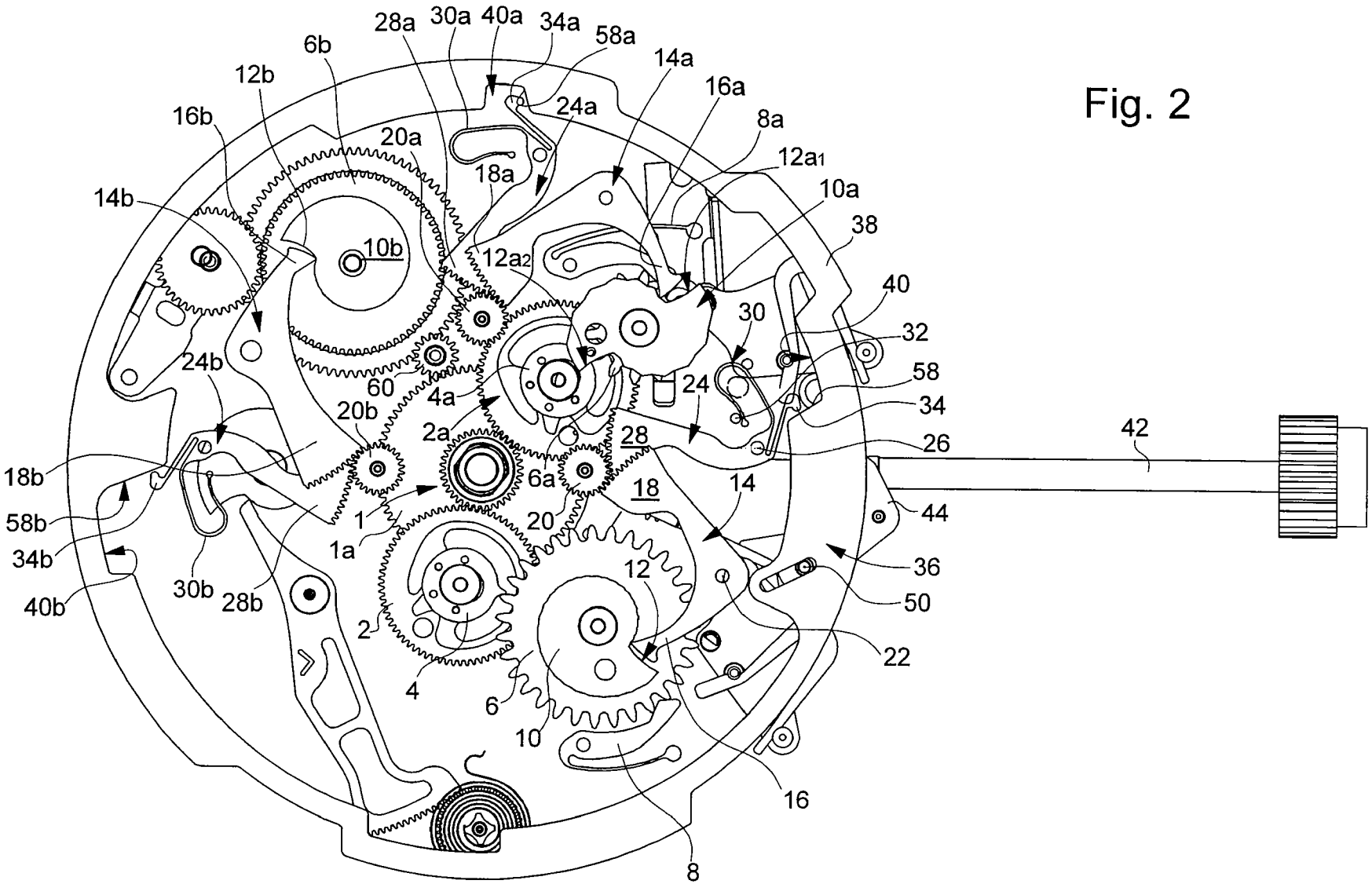
FIG. 2 is a plan view of the correction mechanism according to the invention in the normal operating position.

The timepiece whose correction mechanism is shown in a plan view in FIG. 2 is a time-zone watch including a retrograde 24 hour display corresponding to the local time of the place where the wearer of the watch usually lives and a 12 hour display corresponding to the time of the time zone of the place where the wearer of the watch is staying temporarily. It will be seen hereinafter that if the wearer of the watch wishes to correct the time zone time, he will also have to correct the date indication and the day of the week indication, and that if the wearer of the watch wishes to reset the time of the watch, he will also have to correct the retrograde 24 hour display.

As can be seen in FIG. 2, the correction mechanism of the watch includes in particular at the centre thereof an intermediate wheel 1, which is secured to an hour wheel 1*a*. In other words, intermediate wheel 1*a* rotates in the clockwise direction and completes one revolution in twelve hours. This intermediate wheel 1 meshes with a date drive wheel 2, which rotates anticlockwise at the rate of one revolution per twenty-four hours. This date drive wheel 2 carries a finger 4, via which it drives through one step per day a date wheel 6, which is indexed by a jumper spring 8 and which carries a cam 10. At one place on the profile thereof, the cam has a steep face or step 12, which marks the passage between the date of the last day of a given month and the date of the first day of the following month, in other words between the "31$^{st}$" and the "1$^{st}$". As will be seen in detail hereinafter, it is the presence, on the profile of cam 10, of this steep face 12, which, normally makes it impossible to correct the date backwards.

The correction mechanism according to the invention is completed by a control lever 14 provided at one end thereof with an arm 16, via which it abuts against cam 10 in a normal operating period, and including at the other end thereof a rack 18, via which it meshes with a date display wheel 20, which caries the date indicator 9*a* (not visible in FIG. 2). Control lever 14 pivots at 22 whereas a second lever called the return lever 24, pivots at 26. This return lever 24 has a similar structure to that of control lever 14, including in particular a rack 28, via which it meshes with the date display wheel 20. As can be seen upon examining FIG. 2, return lever 24 is biased by a spring element 30, which tends thus to rotate in the clockwise direction. In turn, return lever 24, thus tends to rotate date display wheel 20 anticlockwise, which tends to rotate control lever 14 clockwise and to hold the arm 16 thereof abutting against the profile of cam 10.

As can be seen upon examining the drawing, in the example shown, spring element 30 is integral with return lever 14 and abuts against a stop member 32 to be rewound. In order to achieve this result, this lever can be made for example by a LIGA photoetching technique. However, it goes without saying that the spring element 30 could be made in the form of a separate part from return lever 24.

At the opposite end to that carrying rack 28, return lever 24 has a sensor portion 34, which cooperates with a disconnecting member designated as a whole by the general reference numeral 36. In the example shown in the drawing, this disconnecting or decoupling member 36 takes the form of an annular cam 38 centred on the centre of the movement and on the inner profile of which sensor portion 34 of return lever 24 abuts. Upon close examination of FIG. 2, it can be seen that that in the situation in which the correction mechanism according to the invention is shown in this Figure, sensor portion 34 of return lever 24 is located by a recess 40 in annular cam 38 on the inner profile thereof. The reason for the presence of this recess 40 will be understood upon reading the following description. It can already be observed that annular cam 38 has two other similar recesses for controlling two other devices for displaying time related quantities as will be explained in detail hereinafter.

It can be seen in FIG. 2 that arm 16 of control lever 14 is at the bottom of steep face 12 on the profile of cam 10. This means that the date indicator mechanism to which date wheel 6 and the associated cam 10 belong has just passed from the last day "31$^{st}$" of a given month, to the first day "1$^{st}$" of the next month. Let us assume now that, starting from this situation, the date has to be corrected. If during this correction, date wheel 6 rotates clockwise, no particular problem will be observed: arm 16 of control lever 14 will follow the profile of cam 10 and drive via the rack 18 thereof date display wheel 20, which will have the effect of incrementing the date indication step by step. However, the same cannot be said if the date indication correction causes a rotation of date wheel 6 and thus cam 10 in the opposite direction. Indeed, in such case, arm 16 of control lever 14 will strike and be blocked against steep face 12 of the profile of said cam 10 and the mechanism will be blocked. This is why, when the date indication is corrected backwards, arm 16 of control lever 14 must be removed from the path of cam 10. Annular cam 38, associated with a control stem 42, is provided for overcoming this problem.

Figure 3A:
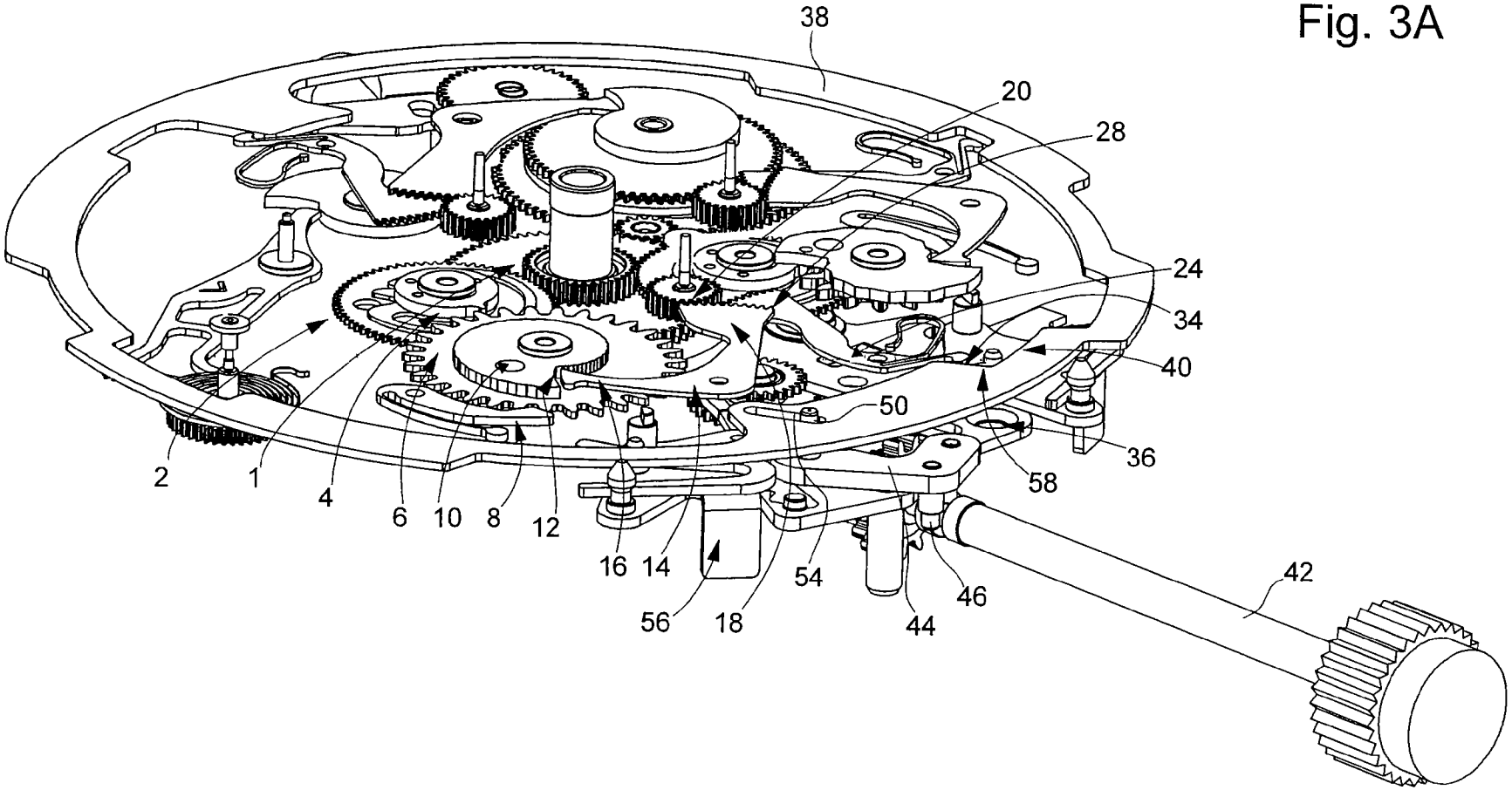
FIG. 3A is a perspective view of the correction mechanism of FIG. 2 showing the correction member actuated by a control stem.
Figure 3B:
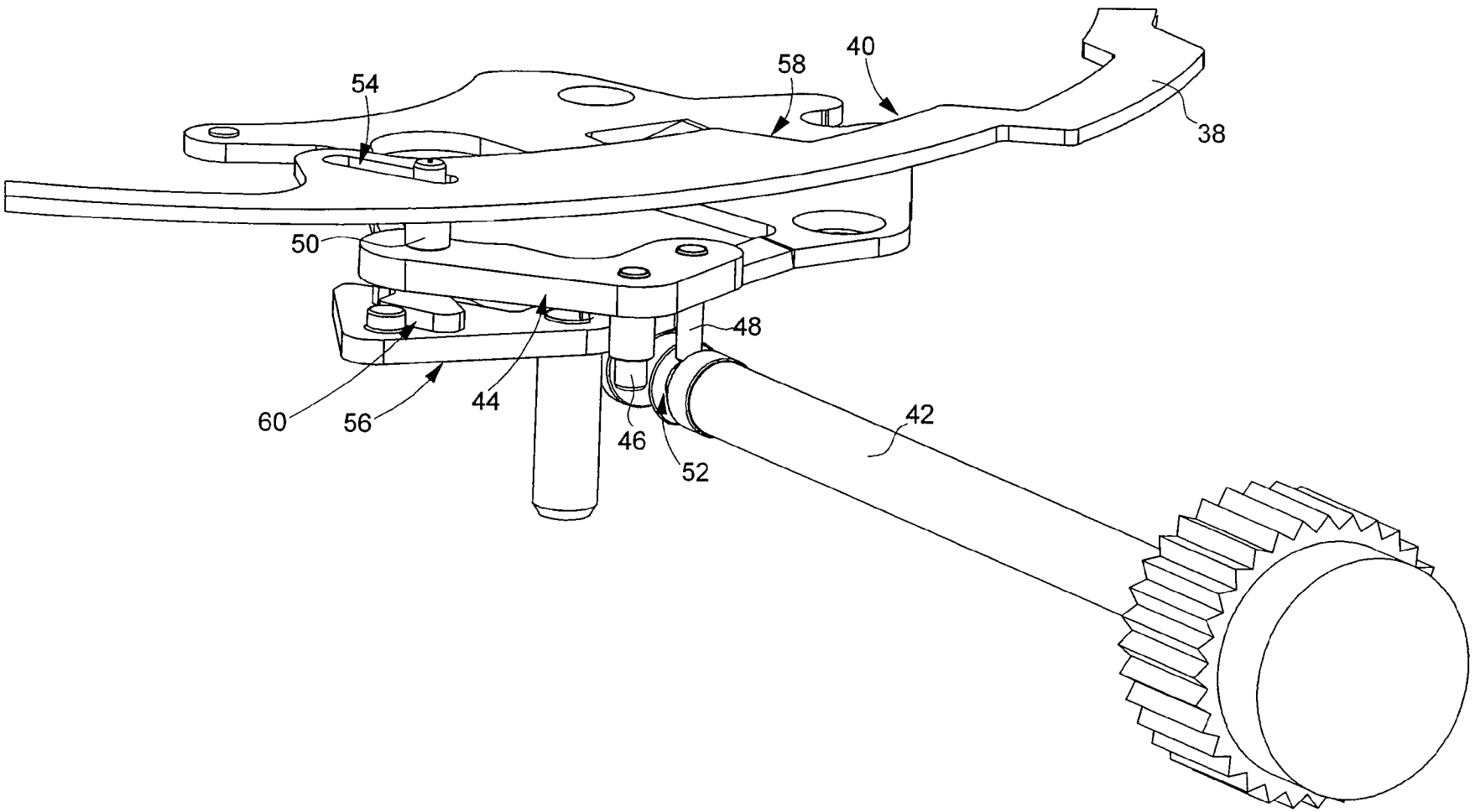
FIG. 3B is a larger scale detailed view of the zone surrounded by a circle in FIG. 3A.

Indeed, as can be seen in FIG. 3A and better still in FIG. 3B, control stem 42 is kinematically connected to annular cam 38 via an element 44, which converts a linear movement of said control stem 42 into a pivoting movement of said annular cam 38. Thus, movement conversion element 44 includes three riveted studs respectively 46, 48 and 50. The first 46 of these three studs forms the pivoting axis of conversion element 44. Via the second stud 48, conversion element 44 is connected to control stem 42. Thus, stud 48 projects into an annular groove 52 provided at one point on the length of control stem 42. Finally, movement conversion element 44 is kinematically coupled to annular cam 38 via the third stud 50, which is free to move in an oblong hole 54 arranged in said annular cam 38.

It was stated above that the correction mechanism according to the present invention is for a timepiece of the time-zone watch type, given that this example is given purely by way of illustration and the present invention could apply to any type of device displaying a time related quantity. Thus, in the case of such a time-zone watch, control stem 42 has three stable positions, namely a neutral position in which the movement can be wound, a first pulled out position in which the 12 hour time zone indicator can be corrected (it is a jump indicator that moves forward or backward by one hour without affecting the minute display) and a second pulled out position in which the time of the watch can be set. These three positions of control stem 42 are conventionally indexed by a pull out piece 56 of the basic movement, which forms the link between a pull out piece jumper spring 60 and said control stem 42.

Figure 3C:
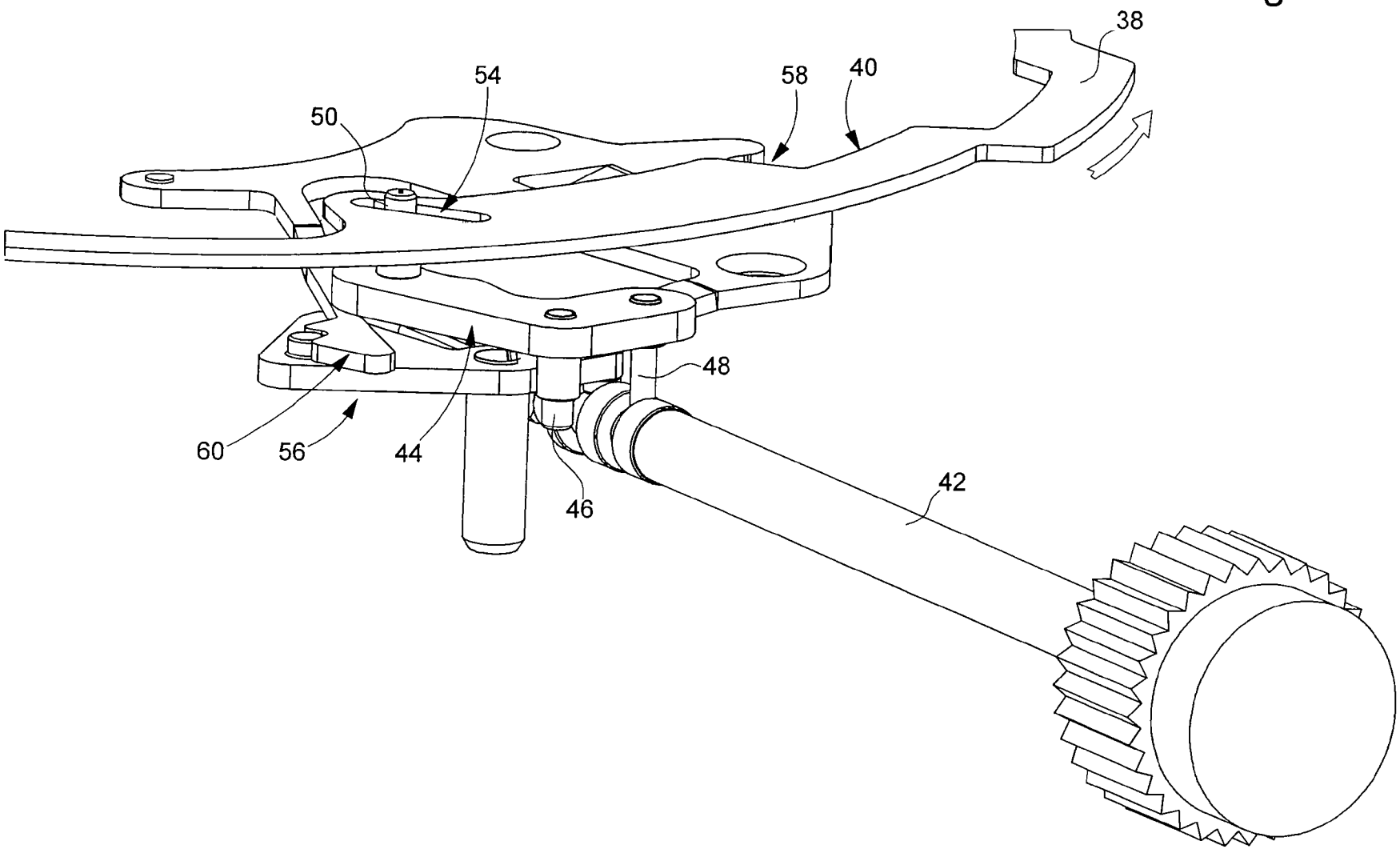
FIG. 3C shows the correction member when it has been actuated by the control stem.

Let us assume now that control stem 42 is pulled in order to move it from the neutral winding position to the first drawn out position. In this case, control stem 42 drives with it stud 48, which causes movement conversion element 44 to pivot about the pivoting axis thereof embodied by stud 46. In turn, stud 50, secured to conversion element 44, slides into oblong hole 54 and causes annular cam 38 to pivot anticlockwise. We are then in the position shown in FIG. 3C in which annular cam 38 has rotated anticlockwise.

Figure 4:
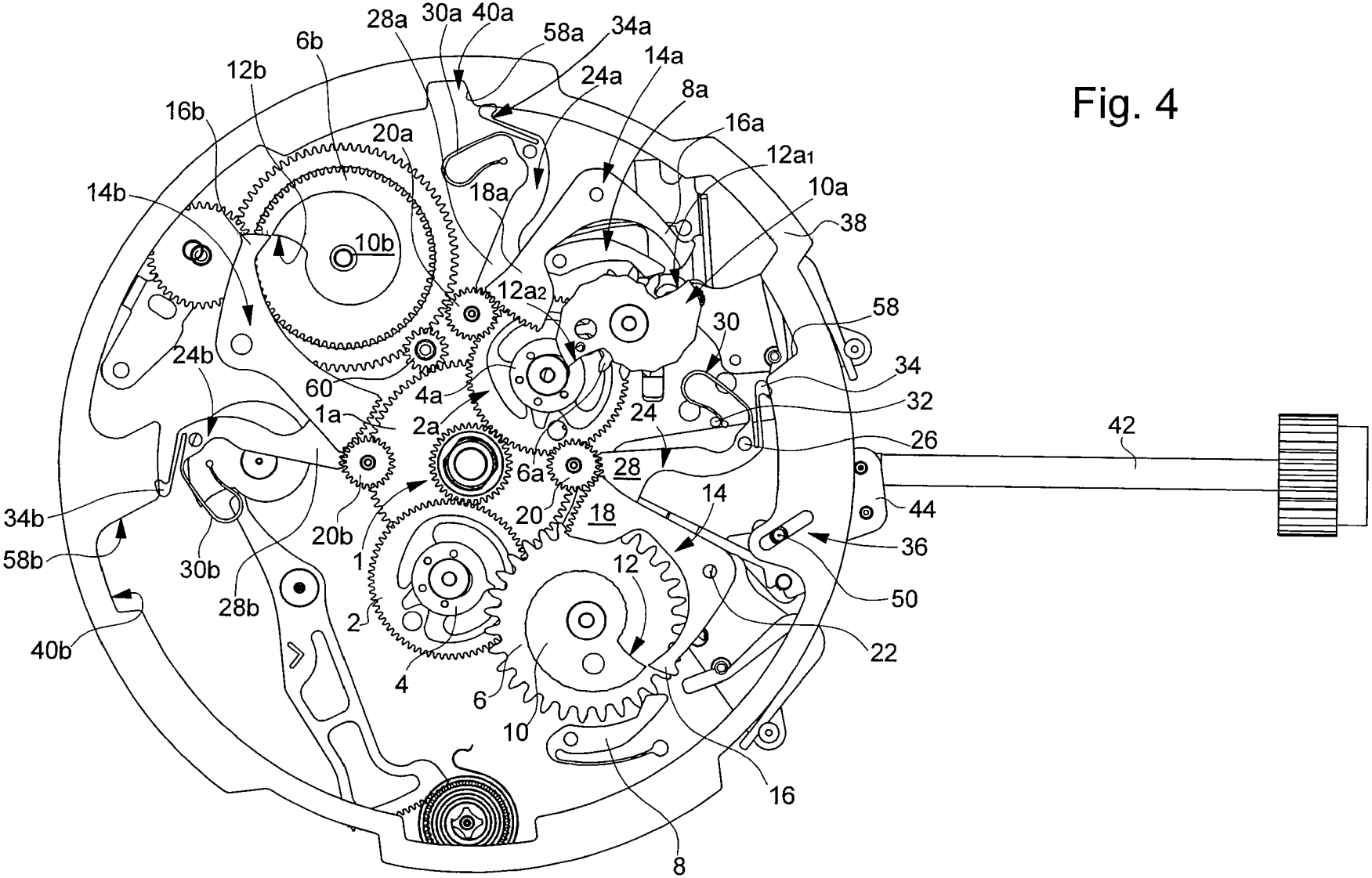
FIG. 4 shows the correction mechanism of FIG. 2 in the disconnected position in which the arms of the control levers are out of the path of the cams.

The anticlockwise pivoting of annular cam 38 moves arm 16 of control lever 14 away from the path of cam 10 as illustrated in FIG. 4. In fact, via the effect of the pivoting of said annular cam 38, sensor portion 34 of return lever 24 climbs back along the face 58 of recess 40 and slides over the inner perimeter of annular cam 38. While doing so, return lever 24 pivots anticlockwise and, via date display wheel 20, causes control lever 14 also to pivot anticlockwise, which has the effect of moving arm 16 of control lever 14 away from the path of cam 10. It will be clear that during this movement, date indicator 9*a* (not visible in FIG. 2) driven by date display wheel 20, will move and go to the bottom of the date scale, i.e. slightly beyond the date "31$^{st}$".

Let us now consider the reasons why it is necessary to move arm 16 of control lever 14 away from the path of cam 10. Assuming that control stem 42 is brought into its first pulled out position, this means that one wishes the correct the time zone time indication. Thus, control stem 42 will be rotated forwards or backwards depending upon whether one wishes to increment or decrement the time zone time indication by one hour steps. When control stem 42 is rotated, the hour wheel (not shown) is rotated and thus also intermediate wheel 1. If intermediate wheel 1 is rotating clockwise, in other words the direction in which it rotates in normal operating mode, cam 10 rotates clockwise and arm 16 of control lever 14 slides along the profile of said cam 10 without any problem. However, if intermediate wheel 1 rotates anticlockwise in the clockwise time zone indication correction phase, cam 10 will rotate clockwise and arm 16 of control lever 14 will strike the steep face 12 of said cam 10 and be blocked. This is why, in such case, arm 16 of control lever 14 must be moved out of the path of cam 10.

As was already mentioned in the preamble, the present invention is not limited to a correction mechanism for a date display device. Indeed, the present invention applies very generally to any type of display of a time related quantity such as, amongst other examples, a device displaying the days of the week or a 24 hour display device as appears in FIGS. 2 and 4 annexed to this Patent Application. It will be observed, upon examining these Figures that in addition to the date display device, the Applicant has fitted the movement with a device displaying the days of the week which, essentially, has the same structure as the date display device. More specifically, this day display device includes a drive wheel for the days 2*a* which rotates anticlockwise while being driven by intermediate wheel 1. This day drive wheel 2*a* carries a finger 4*a* via which it drives, at a rate of one step per day, a day wheel 6*a*, which includes fourteen teeth and which thus completes one revolution in fourteen days. Thus, the day wheel 6*a* carries a cam 10*a* which has a dual cam profile with two steep faces $\mathbf{12}a_1$ and $\mathbf{12}a_2$ which are symmetrical relative to the geometrical centre of said cam 10*a*. it goes without saying that this cam profile is simply a question of choice on the part of the designer and that a cam with a simple profile could very well have been used, completing one revolution in seven days, like cam 10 carried by date wheel 6. Each of the two steep faces $\mathbf{12}a_1$ and $\mathbf{12}a_2$ of cam 10*a* marks the passage of the day indicator from the last day of a week to the first day of the following week, i.e. from Sunday to Monday. It will be noted that day wheel 6*a* is indexed by a jumper spring 8*a*.

The correction mechanism for the day display device is completed by a control lever 14*a* which, via its arm 16*a* abuts against the profile of cam 10*a* and which meshes via its rack 18*a* with a day display wheel 20*a*. A return lever 24*a* is also provided, biased by a spring 30*a* and which, at one end thereof, includes a rack 28*a* via which it meshes with the day display wheel 20*a*, whereas at the other end thereof, it includes a sensor portion 34*a*, which is located in a recess 40*a* on the inner profile of annular cam 38.

It will be recalled here that we are concerned with a time zone watch. Consequently, in the first pulled out position of control stem 42, when one wishes to correct the time zone time while leaving the local time unchanged, the date and day indication must be simultaneously corrected. The date indication correction has already been described in detail above. Correction of the day indication is carried out in an identical manner. Indeed, when control stem 42 is rotated and this causes annular cam 38 to pivot anticlockwise, sensor portion 34*a* of return lever 24*a* climbs along side 58*a* of recess 40*a* and slides over the inner perimeter of annular cam 38. Via the effect of the movement of its sensor portion 34*a*, return lever 24*a* pivots anticlockwise and, via day display wheel 20*a*, causes control lever 14*a* also to pivot anticlockwise. This has the effect of moving arm 16*a* of control lever 14*a* out of the path of cam 10*a*. It will be understood that during this movement, day indicator 11*a* (not visible in FIG. 2), driven by day display wheel 20*a*, will move and go to the bottom of the day scale, slightly beyond the Sunday indication.

It will be noted thus that by a single action on the control stem, one can simultaneously correct the time zone time both clockwise and anticlockwise, the date indication and the day indication, simply by providing, opposite sensor portions 34, 34*a* of return levers 24, 24*a*, two recesses 40, 40*a* on the inner profile of annular cam 38. The correction device according to the present invention is thus characterized by the simplicity of the means implemented and by the great ease of use.

When control stem 42 is made to pass from its first to its second pulled out position in order to set the time of the watch, this causes additional pivoting of annular cam 38. This additional pivoting however has no effect on return levers 24, 24*a* since their respective sensor portions 34, 34*a* have climbed the sides 58, 58*a* of recesses 40, 40*a* and slide over the inner perimeter of annular cam 38. Arms 16, 16*a* of control levers 14, 14*a* thus still remain outside the path of cams 10, 10*a*.

It was already specified above that the watch also included a 24 hour local time display. Consequently, when the position of the hour and minute hands is corrected, the 24 hour indication must also be able to be corrected. Thus, the 24 hour display device includes an intermediate wheel 60 driven by the watch movement and which meshes with a 24 hour wheel 6*b* which carries a cam 10*b*. At one place on its profile, this cam 10*b* has a steep face 12*b* which marks the passage between the twenty-fourth hour of a day and the first hour of the next day. A control lever 14*b* abuts via its arm 16*b* against the profile of cam 10*b* and meshes with a 24 hour display wheel 20*b* via its rack 18*b*. Likewise, a return lever 24*b* biased by a spring element 30*b* meshes via its rack 28*b* with the 24 hour display wheel 20*b*. This return lever 24*b* also includes a sensor portion 34*b*, which, in the normal operating position of the watch (see FIG. 2) is inside a recess 40*b*. When control stem 42 is brought into its first pulled out position in which it is possible to correct the time zone time, annular cam 38 pivots and sensor portion 34*b* climbs along side 58*b* of recess 40*b* and slides over the inner perimeter of said annular cam 38. Via the effect of the movement of its sensor portion 34*b*, return lever 24*b* pivots anticlockwise and, via 24 hour display wheel 20, causes control lever 14*b* to pivot, also anticlockwise. The effect of this is to move arm 16*b* of control lever 14*b* out of the path of cam 10*b*.

Nonetheless, in the first pulled out position of control stem 42, the fact of rotating stem 42 in one direction or the other to correct the time zone time has no effect on the 24 hour display. Indeed, in its first pulled out position, control stem 42 interacts with another gear train which is connected to the 24 hour display device. Conversely, in the second pulled out of the control stem corresponding to the watch time setting, the control stem interacts with another gear train which is connected to the 24 hour display device. Consequently, in the second pulled out position of control stem 42, the 24 hour display device can be corrected without any problem, since arm 16*b* of control lever 14*b* has already been moved out of the path of am 10*b* when said control stem 42 is brought into its first pulled out position.

It goes without saying that he present invention is not limited to the embodiment that has just been described and that those skilled in the art can envisage various simple alterations and variants without departing from the scope of the invention defined by the annexed claims. In particular, it will be clear that when the control stem is returned to its neutral winding position, the annular cam returns to its original position and the sensor portions fall back into their respective recesses. Via the effect of the movement of the sensor portion, the return lever pivots the display wheel and the control lever returns to abut against its cam. During the correction phase, the cam will have rotated and the control lever will abut against the latter at a different place from the place where it was abutting prior to correction, such that the correction carried out will be taken into account by the display device.

What is claimed is:

1. A timepiece including a two-directional corrector mechanism for a display device a time related quantity, the display device being actuated by a control lever which is itself controlled by a cam on which the control lever abuts, wherein the timepiece includes a correction member actuated by a control stem, which, in a display device correction phase moves, via a return lever, the control lever out of the path of the cam on which said control lever normally abuts during the normal operating phase of the timepiece.

2. The timepiece according to claim 1, wherein the return lever also causes the control lever to abut against the cam outside the display device correction periods.

3. A timepiece including a two-directional corrector mechanism for a display device a time related quantity, the display device being actuated by a control lever which is itself controlled by a cam on which the control lever abuts, wherein the timepiece includes a correction member actuated by a control stem, which, in a display device correction phase moves, via a return lever, the control lever out of the path of the cam on which said control lever normally abuts during the normal operating phase of the timepiece, wherein the control lever includes an arm via which said lever abuts on the cam and a rack via which said levers meshes with a display member of the display device, and wherein the return lever also includes a rack via which said return lever meshes with the display member and a sensor portion via which said return lever abuts on the correction member.

4. The timepiece according to claim 3, wherein the correction member is capable of pivoting.

5. The timepiece according to claim 4, wherein the correction member is an annular cam actuated by the control member and on the profile of which the sensor portion abuts.

6. The timepiece according to claim 5, wherein the annular cam has a recess in at least one place on the profile thereof, in which the sensor portion is located outside the display device correction periods, the recess having a side along which the sensor portion climbs to then slide over the inner perimeter of said annular cam in the display device correction phase.

7. The timepiece according to claim 4, wherein the control stem is kinematically connected to the annular cam via an element that converts a linear movement of said control stem into a pivoting movement of said annular cam.

8. The timepiece according to claim 7, wherein the movement conversion element pivots about an axis and includes a first stud via which said element is connected to the control stem and a second stud via which said element is connected to the annular cam.

9. The timepiece according to claim 8, wherein the first stud projects into a groove made on the control stem and wherein the second stud projects into an oblong hole made in the annular cam.

10. The timepiece according to claim 4, wherein it includes a date drive wheel which carries a finger via which said wheel drives at a rate of one step per day a date wheel which carries the date cam, said date drive wheel itself being driven by an intermediate wheel, which is driven by the movement, the forward movement of the date wheel being transmitted to the date display wheel, via the control lever abutting against the date cam.

11. The timepiece according to claim 10, wherein the date cam has a steep face or step, which marks the passage from the "31$^{st}$" day to the "1$^{st}$" day.

12. The timepiece according to claim 4, wherein it further includes a drive wheel for the days of the week, which carries a finger via which said wheel drives at a rate of one step per day a day wheel that carries the day cam, said day drive wheel being itself driven by an intermediate wheel which is driven by the movement, the forward movement of the day wheel being transmitted to the day display wheel, via the control lever abutting against the day cam.

13. The timepiece according to claim 12, wherein the day cam has a steep face or step that marks the passage from Sunday to Monday.

14. The timepiece according to claim 4, wherein the 24 hour cam is carried by a 24 hour wheel, which is driven by an intermediate wheel itself driven by the watch movement, the forward movement of the 24 hour wheel being transmitted to the 24 hour display wheel, via the control lever abutting against the 24 hour cam.

15. The timepiece according to claim 10, wherein the 24 hour cam has a steep face that marks the passage between 24:00 hours and 01:00 hour.

16. A timepiece including a two-directional corrector mechanism for a display device a time related quantity, the display device being actuated by a control lever which is itself controlled by a cam on which the control lever abuts, wherein the timepiece includes a correction member actuated by a control stem, which, in a display device correction phase moves, via a return lever, the control lever out of the path of the cam on which said control lever normally abuts during the normal operating phase of the timepiece;

wherein the return lever also causes the control lever to abut against the cam outside the display device correction periods; and wherein the control lever includes an arm via which said lever abuts on the cam and a rack via which said levers meshes with a display member of the display device, and wherein the return lever also includes a rack via which said return lever meshes with the display member and a sensor portion via which said return lever abuts on the correction member.

17. The timepiece according to claim 16, wherein the correction member is capable of pivoting.

18. The timepiece according to claim 17, wherein the correction member is an annular cam actuated by the control member and on the profile of which the sensor portion abuts.

19. The timepiece according to claim 18, wherein the annular cam has a recess in at least one place on the profile thereof, in which the sensor portion is located outside the display device correction periods, the recess having a side along which the sensor portion climbs to then slide over the inner perimeter of said annular cam in the display device correction phase.

* * * * *